US006487272B1

(12) United States Patent
Kutsuzawa

(10) Patent No.: US 6,487,272 B1
(45) Date of Patent: Nov. 26, 2002

(54) PENETRATING TYPE X-RAY TUBE AND MANUFACTURING METHOD THEREOF

(75) Inventor: Hiroki Kutsuzawa, Tochigi-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/498,370

(22) Filed: Feb. 4, 2000

(30) Foreign Application Priority Data

Feb. 19, 1999 (JP) ..... 11-041392
Dec. 27, 1999 (JP) ..... 11-371002

(51) Int. Cl.[7] ..... H01J 35/02
(52) U.S. Cl. ..... 378/140; 378/142; 378/129
(58) Field of Search ..... 378/140, 142, 378/129

(56) References Cited

U.S. PATENT DOCUMENTS 4,158,770 A * 6/1979 Davis et al. ..... 378/124
5,226,067 A * 7/1993 Allred et al. ..... 378/161
5,264,801 A * 11/1993 DeCou, Jr. et al. ..... 378/129
5,689,542 A * 11/1997 Lavering et al. ..... 378/142
6,005,918 A * 12/1999 Harris et al. ..... 378/140

FOREIGN PATENT DOCUMENTS

JP 52-056778 12/1977
JP 54-163885 11/1979

* cited by examiner

*Primary Examiner*—David V. Bruce
*Assistant Examiner*—Pamela R. Hobden
(74) *Attorney, Agent, or Firm*—Oblon, Spivak, McClelland, Maier & Neustadt, P.C.

(57) ABSTRACT

The object of this invention is to provide a highly reliable penetrating type X-ray tube and a manufacturing method thereof, preventing interfacial exfoliation between a transmission window and a target film before it happens.

This invention is characterized in that at least one intermediate film 39 of at least one metal element or an alloy thereof selected from a group of copper, chromium, iron, nickel, etc. between x-ray penetrating window plate 37 of beryllium stuck vacuum-tightly to a portion of evacuated envelope 33, and target film 40 of tungsten which is provided on the evacuated side of the window plate and emanates X rays is formed by a physical method such as spattering.

11 Claims, 4 Drawing Sheets

PENETRATING TYPE X-RAY TUBE AND MANUFACTURING METHOD THEREOF

BACKGROUND OF THE INVENTION

1. Field of the Invention

This invention relates to a X-ray tube such as a penetrating type X-ray tube, especially to an X-ray tube of this kind where exfoliation at the interface of a target film from which X rays generate, formed on the inner surface of an X-ray transmission window plate being a part of its evacuated envelope is prevented from occurring and to a manufacturing method thereof.

2. Description of the Related Art

An X-ray tube has a structure in which X rays are emanated by an electron beam collided with an anode target. The X-ray tube is used in various fields such as industrial use e.g. medical diagnosis, nondestructive testing or material analysis. Various kinds of X-ray tubes are in use according to these demands. Among them, there is a transmission emanating type X-ray tube that offers a minute focal spot, i.e. micro focus X-ray source.

One of utilization of the micro focus transmission emanating type X-ray tube is an X-ray fluoroscopic magnified image pickup device for semiconductor integrated circuit boards or other objects. As shown in FIG. 7, X-ray tube 12 is accommodated in device case 11 which shields X rays. Object 13 such as the semiconductor integrated circuit board is set at the position apart from X-ray focal point S of X-ray tube 12 by the distance La. Furthermore at the position apart from object 13 by the distance Lb, the sensor surface of X-ray area sensor such as an X-ray image tube or a solid state X-ray sensor is positioned facing thereto.

An operating voltage which is controlled from outside is to be supplied to X-ray tube 12 by means of power source 15 contained in case 11. An X-ray image signal derived from X-ray image signal output section 16 of X-ray area sensor 14 is transmitted to monitor 17 having a image processing device so as to display an X-ray fluoroscopic magnified image of object 13 on image display section 18.

Magnification M of an X-ray imaging of an object is represented approximately by M=(La+Lb)/La. Since both the distances are set to be La((Lb, the smaller the distance La becomes, the larger the magnification M increases. It is also self-evident that the smaller the size of focus S which is the origin of X rays in the X-ray tube is, the clear the X-ray fluoroscopic magnified image becomes.

Therefore, it is desirable that the focus S of the X-ray tube, i.e. the X-ray emanating target section should be located as close as possible to object 13, in order to make distance La as small as possible. For this purpose, utilization of a micro focus transmission emanating type X-ray tube in which an X-ray emanating target is at the utmost tip of the tube is suitable.

As shown in FIG. 8, such X-ray tube 12 has X-ray transmission window 22 permeable to X rays, provided vacuum-tightly at one of the tips of the metallic hollow cylinder of evacuated envelope 21. Transmission window 22 is usually made of a material highly permeable to X rays such as beryllium (Be). On the surface of the evacuated side of transmission window 22, anode target film 23 of tungsten (W) etc. is directly stuck, as the main part is shown magnified. Inside the glass portion of the other side of the evacuated envelope, cathode 24 emitting an electron beam is mounted and electron gun 25 comprising the cathode and a plurality of grid electrodes for an electron lens is accommodated.

In the above mentioned structure, electron beam e emitted out of the cathode and passing through electron lens 25 is designed to make point focus S at anode target film 23. Then, X rays generated at the anode target film are emanated out as they are, via transmission window 22. The emanated X rays represented by mark X are used for X-ray imaging.

The apparatus or the X-ray tube like this is disclosed, for example, in U.S. Pat. No. 5,077,771, Japanese Patents No. 2,713,860, No. 2,634,369, Japanese Patent Publication No. Hei/7-50594, Japanese Patent Disclosure No. Hei/9-171788, Japanese Utility Model Publication No. Shou/52-56778, and Japanese Utility Model Disclosure No. Shou/54-163885.

The optimum thickness of the tungsten film constituting the anode target of the transmission emanating type X-ray tube depends on the voltage supplied to the tube. For instance, in the case of industrial X-ray tubes, the voltage supplied to the X-ray tube is generally in the range from several tens kV to one hundred and several tens kV. In such a case, the optimum thickness of the tungsten film constituting the anode target is in the range from several $\mu$m to ten and several $\mu$m.

The structure where a tungsten film constituting the anode target is directly stuck to the inner surface of the beryllium X-ray transmission window is apt to generate an interfacial exfoliation between tungsten and beryllium, and to result in unstable state, under the influence of the remaining stress in the film generated while the tungsten film is being formed or of the difference of thermal expansion coefficient between tungsten and beryllium constituting the transmission window.

Especially, for a micro focus penetrating-type X-ray tube, the interfacial exfoliation is liable to take place at the micro focus part, because an electron beam having, for example, a focus of substantially circular configuration of several tens $\mu$m or less in diameter impinges on the tungsten film. If the interfacial exfoliation takes place, it is thought that melting of the tungsten film or spattering of exfoliated material caused by local irradiation of the electron beam may result in serious damage of the X-ray tube.

SUMMARY OF THE INVENTION

The object of this invention is to solve the above mentioned shortcomings and to provide a highly reliable penetrating type X-ray tube and a manufacturing method thereof, preventing interfacial exfoliation between a transmission window and a target film before it happens.

The penetrating type X-ray tube according to the present invention has a X-ray transmission window plate of beryllium stuck vacuum-tightly to a portion of an evacuated envelope, a target film of tungsten or of an alloy mainly constituted of tungsten which is provided on the evacuated side of the window plate and emanates X rays, and at least one intermediate film of at least one metal element such as copper or of a material principally constituted of this metal element intervening closely between the window plate and the target film.

The manufacturing method according to the present invention is characterized in that at least one intermediate film of at least one metal element selected from copper, chromium, iron, nickel, etc. or of a material principally constituted of this metal element and an X-ray generating target film are formed on the inner surface of the X-ray transmission window of beryllium and on the intermediate film respectively by a physical vapor deposition method such as spattering.

DETAILED DESCRIPTION OF THE PREFERRED EMBODIMENTS

Figure 1:
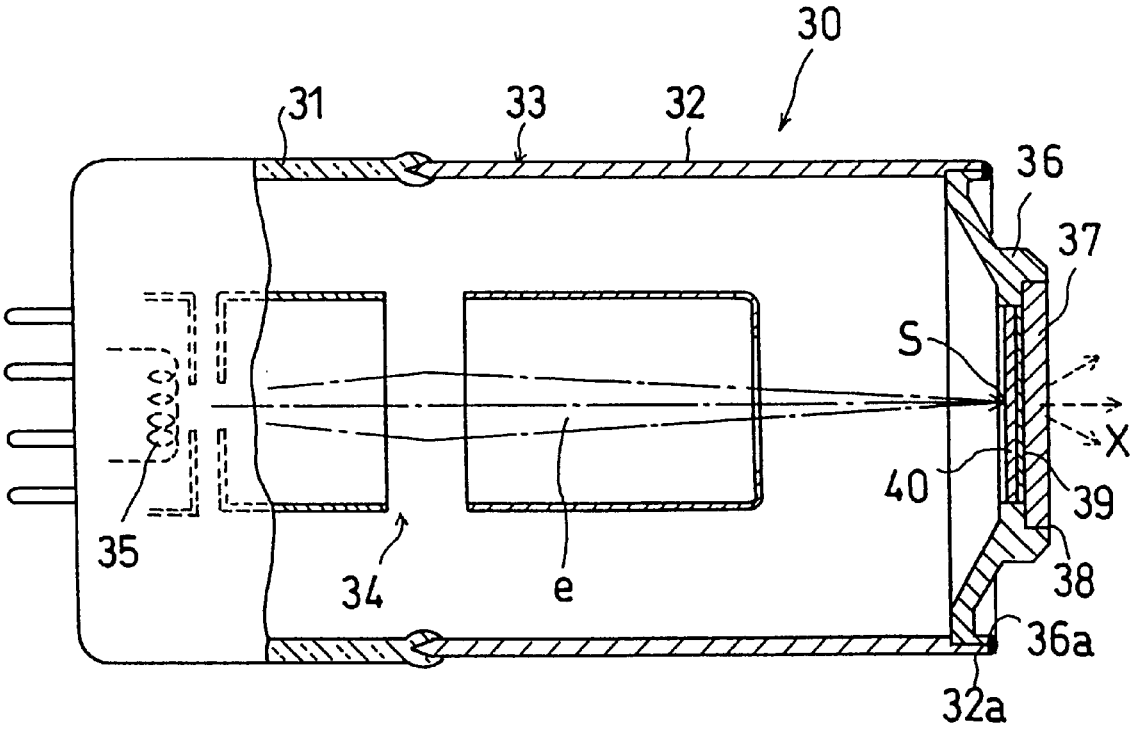
FIG. 1 is a cross section of an X-ray tube showing an embodiment of the invention.
Figure 2:
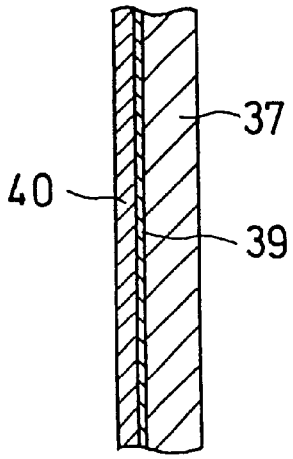
FIG. 2 is a cross section magnifying the main part of FIG. 1.

Embodiments of the present invention will now be described in more detail with reference to the accompanying drawings.

Referring to FIG. 1 to FIG. 4, an embodiment of this invention will be explained. Micro focus penetrating type X-ray tube 30 shown in these figures has evacuated envelope 33 comprising glass envelope section 31 and metal hollow cylinder section 32 having a closed end and sealed vacuum-tightly to glass envelope section 31. Inside evacuated envelope 33, electron gun 34 is placed. Electron gun 34 comprises cathode 35 generating an electron beam and a plurality of grid electrodes for an electron lens. For the X-ray tube of this embodiment, an electron beam accelerating voltage, i.e. an operating voltage applied between the cathode and the anode target film is in the range from 50 to 70 kV.

X-ray transmission window 37 of beryllium (Be) or of an alloy mainly constituted of beryllium having high X-ray permeability is hermetically hard-soldered to X-ray transmission window holding ring 36 by means of hard-soldering layer 38 at the tip of metal hollow cylinder section 32 of the evacuated envelope. x-ray transmission window holding ring 36 is made of mechanically strengthened material such as thick iron (Fe), iron alloy (e.g. Kovar (trade name) or stainless steel), copper (Cu), or copper alloy. Tapered outer peripheral thin section 36*a* elongating outside is hermetically sealed to end opening section 32*a* of the metallic hollow cylinder portion. by arc welding.

On the inner surface of X-ray transmission window plate 37 i.e. the vacuum side surface, intermediate film 39 of pure copper (Cu) and anode target film 40 of tungsten (W) are formed and piled up in the above order. When the X-ray tube is operating, electron beam e generated from cathode 35 and passing through electron gun 34 is to be converged on the focus S at anode target film 40, as mentioned in the conventional technology. X rays generated at the focus are emanated outside through X-ray transmission window to be used for X-ray imaging, etc.

Next, referring to FIG. 3 and FIG. 4, preferred assembling or forming process of X-ray transmission window plate 37, intermediate film 39 and anode target film 40 will be explained. First of all, soldering material such as silver alloy solder constituted 50% of silver and 50% of copper was placed on step 36*b* of window holding ring 36, which had been machined to a predetermined shape in advance, and X-ray transmission window plate 37 of a beryllium disc of 1 mm in thickness was placed thereon, and then hermetic hard-soldering was carried out with melting solder 38 after heat-treated in non-oxidizing atmosphere.

Figure 3A:
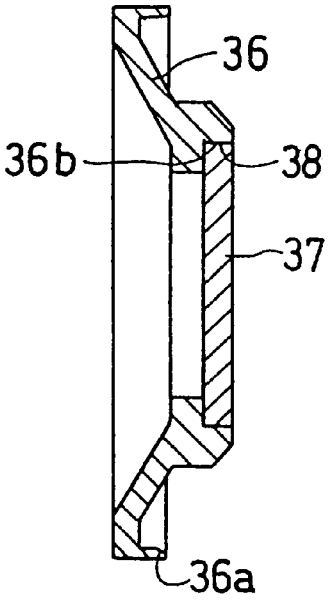
FIG. 3 is a cross section of the main part showing an assembling and forming process of an X-ray emanating window plate and a target film of FIG. 1.
Figure 3B:
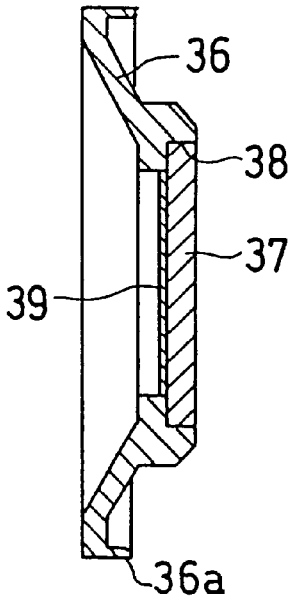
Figure 3C:
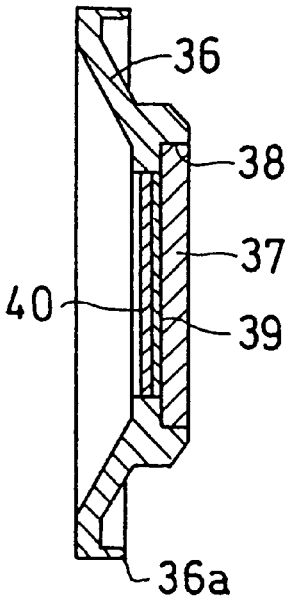
Figure 4:
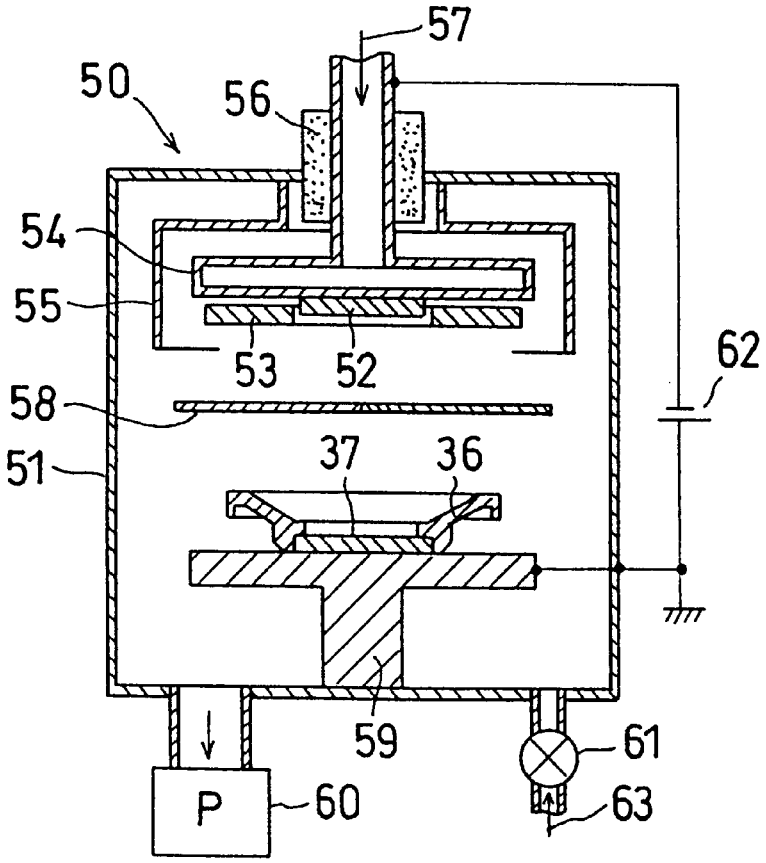
FIG. 4 is a schematic view showing a spattering apparatus applied for the manufacturing methods of this invention.

Next, the above assembled body was placed in spatter-filming apparatus 50 shown in FIG. 4, and then intermediate film 39 of copper was formed by approximately 0.4 $\mu$m in thickness and stuck directly on the inner surface of X-ray transmission window 37 of beryllium bonded to window holding ring 36 by means of spattering method as shown in FIG. 3(*b*).

Then, film 40 of tungsten was formed by approximately 4 $\mu$m in thickness and stuck on intermediate film 39 of copper in the same spatter-filming apparatus by means of spattering method as shown in FIG. 3(*c*). Then, window holding ring 36 having X-ray transmission window plate 37 on which the intermediate film and tungsten film were thus formed was put in end opening section 32*a* of the metallic hollow cylinder portion as shown in FIG. 1, and the thin cylindrical ends of the above two parts contacting together were hermetically sealed by arc welding to make a vacuum envelope. An electron gun, etc. were assembled in the vacuum envelope, and an X-ray tube was completed after exhausting process.

Spatter-filming apparatus 50 shown in FIG. 4 is a conventional direct current (DC) bipolar spattering apparatus. Mark 51 is a vacuum or depressurizing vessel, marks 52, 53 are target materials for spattering, mark 54 is a target holder holding these target materials, mark 55 is a shield, mark 56 is an insulator, mark 57 is a cooling medium which circulates in the target holder to cool the target materials, mark 58 is a shutter, mark 59 is a board-holding table holding a film-formed board, mark 60 is a vacuum pump, mark 61 is a control valve controlling introduction of discharge gas such as argon, and mark 62 is a DC power source.

Window holding ring 36 soldered to X-ray transmission window plate 37 of beryllium shown in FIG. 3(*a*) is put on board-holding table 59 and grounded together with depressurizing vessel 51. On the other hand, target material 52 of copper and target material 53 of tungsten are put on target holder 54 so that the two materials can be replaceable with each other. Target holder 54 is connected to the negative terminal of DC power source 62. After the inside of depressurizing vessel 51 is exhausted, discharging gas 63 is introduced therein as shown by an arrow and regulated to a predetermined pressure, for example 10 Pa. A predetermined voltage such as 1 kV is applied from DC power source 62 to generate discharge plasma in the depressurizing vessel. Then, the intermediate film of copper is formed on the inner surface of X-ray transmission window plate 37 with target material 52 of copper by controlling shutter 58.

Next, the target film of tungsten is formed on the intermediate film, by replacing target material 52 with target material 53 of tungsten. Thus, intermediate 39 and target film 40 are consecutively piled up and formed on the inner surface of transmission window plate 37 of the X-ray tube as shown in FIG. 3(*c*).

Figure 5:
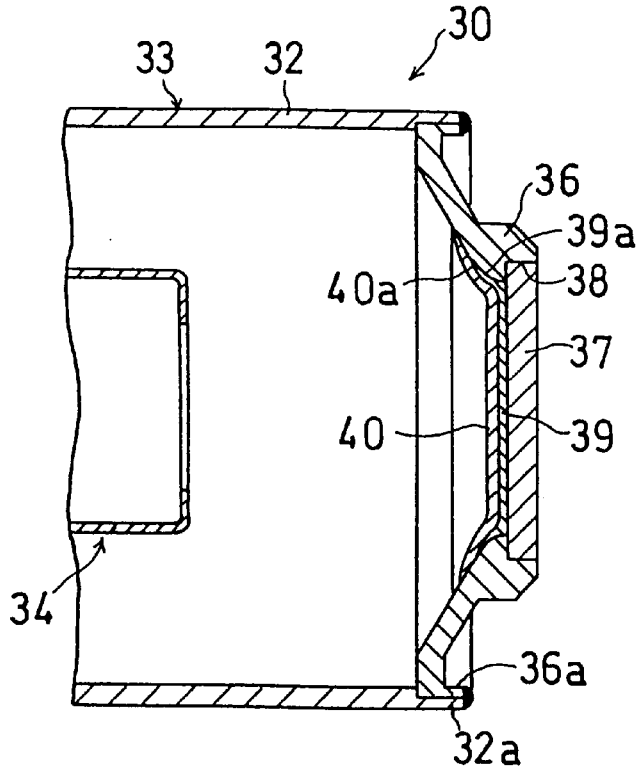
FIG. 5 is a cross section of the main part of an X-ray tube showing another embodiment of this invention.

The embodiment shown in FIG. 5 is that intermediate film 39 of copper and target film 40 of tungsten cover not only the inner surface of X-ray transmission window 37 of beryllium but also an extra region as far as the middle of the tapered inner surface of transmission window holding ring 36 by spattering. The expanded regions of the intermediate film and the target film are denoted by marks 39*a*, 40*a* respectively.

According to this embodiment, no inconvenience will occur in operating the X-ray tube. On the contrary, there is an advantage that masking for forming intermediate film 39 and target film 40 does not need to be so precisely arranged.

Figure 6:
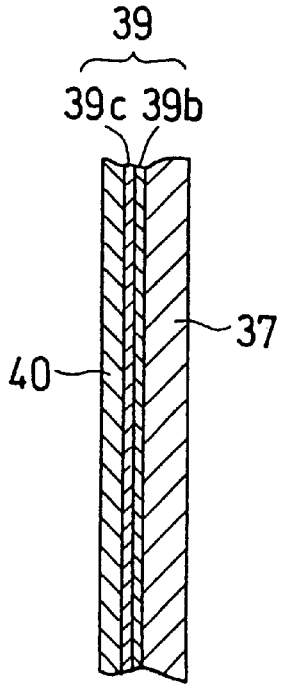
FIG. 6 is a cross section of the main part of an X-ray tube showing further embodiment of this invention.
Figure 7:
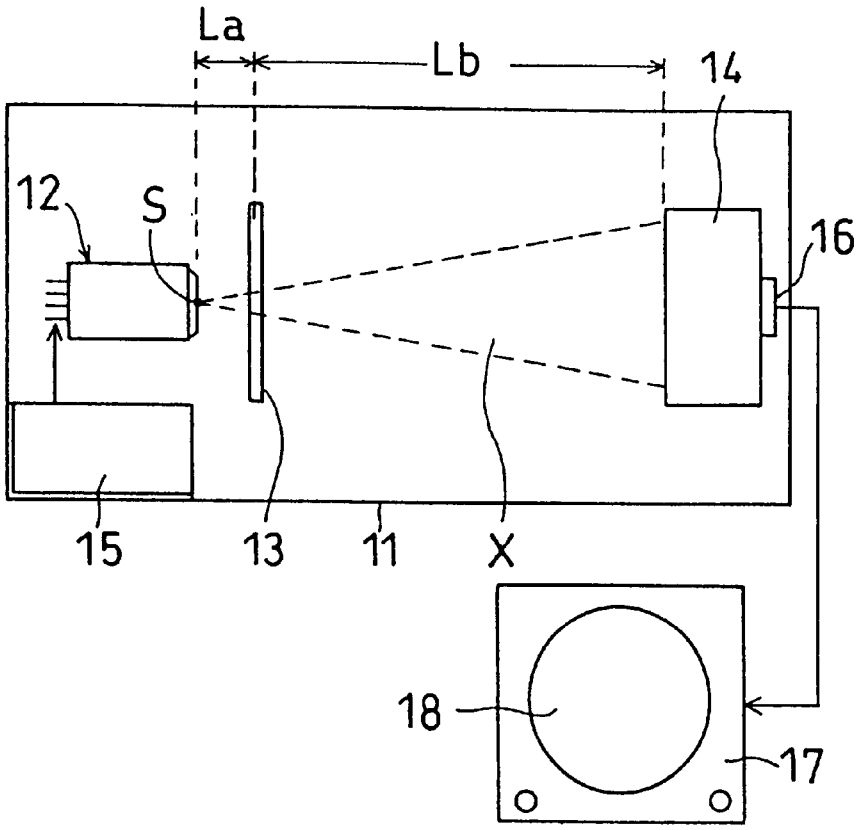
FIG. 7 is a schematic view showing an X-ray magnified imaging apparatus.
Figure 8:
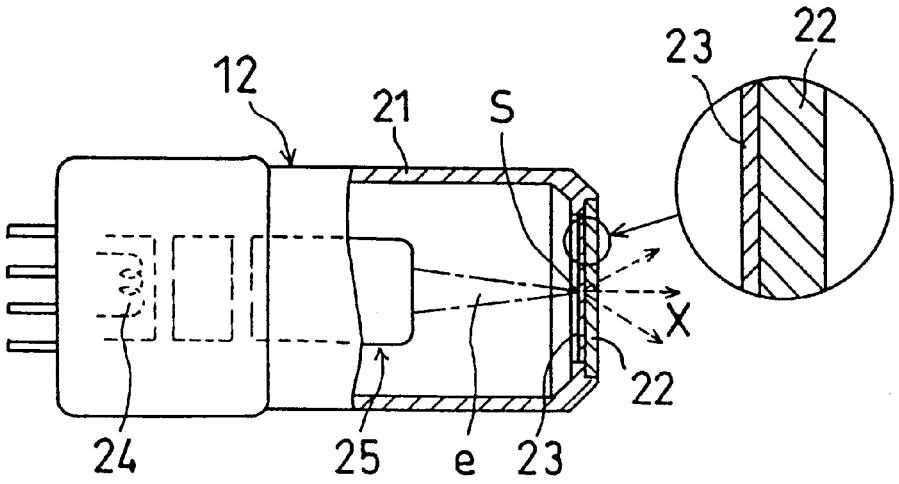
FIG. 8 is a cross section showing a conventional X-ray tube.

The embodiment shown in FIG. 6 is that intermediate film 39 constituted of two layers 39*b*, 39*c* is laminated and formed on the inner surface of X-ray transmission window plate 37 of beryllium, and target film 40 is formed on the inner surface thereof. As materials for two-layered intermediate film 39, iron (Fe) for layer 39*b* at the side of the X-ray transmission window, and titanium (Ti) for layer 39*c* at the side of the target film can be employed. Therefore, the thermal expansion coefficients for these materials are arranged in descending order from beryllium for X-ray transmission window plate 37 to tungsten for target film 40, so that interfacial exfoliation between neighboring layers can be more suppressed.

As for intermediate layers 39*b*, 39*c*, the above materials are not necessarily required, but gold (Au) for intermediate layer 39*b* and chromium (Cr) for intermediate layer 39*c*, for example, can be adopted. Furthermore, copper (Cu) for intermediate layer 39*b* and tantalum (Ta) for intermediate layer 39*c* are also possible. Other various combinations are practicable. Two layers are not necessarily required, but a lamination of three or more of layers can be employed.

For the micro focus penetrating type X-ray tube manufactured by the above process, interfacial exfoliation between the X-ray transmission window plate and the intermediate film of copper, and that between the intermediate film and the target film of tungsten do not occur, even though micro focus X rays continue to radiate for a long time, therefore high reliability has been achieved. Main reasons for the above are that the beryllium plate for the X-ray transmission window and the intermediate film of copper are relatively easy to alloy, the intermediate film is stuck to the beryllium window with high adhesion under high energy by spatter-filming, furthermore in the same way, the target film of tungsten is stuck to the intermediate film with high adhesion, and ion implantation into the base metal at each interfacial portion exists. Thus, it is thought that favorable adhesiveness at each interface is achieved, so that interfacial exfoliation hardly takes place.

Incidentally, the penetration depth of electrons into metal for the same metal is proportional to the acceleration voltage for electrons to the nth power, as is generally known. Here, n is approximately 1.7. In the case where the anode target of the X-ray tube is tungsten, the penetration depth of electrons for 30 kV of acceleration voltage is approximately lam, and the penetration depth of electrons for 100 kV of acceleration voltage is approximately 8 $\mu$m.

Therefore, when the thickness of tungsten film constituting the anode target is approximately 4 $\mu$m as the embodiment mentioned above, the penetration depth of electrons is approximately 2.5 $\mu$m from the surface of the tungsten film under operation of 50 kV of acceleration voltage, and approximately 4 $\mu$m from the surface of the tungsten film, i.e., substantially whole depth of the tungsten film under operation of 70 kV of acceleration voltage, so that X rays radiate effectively and electrons do not reach the intermediate film of copper and the X-ray transmission window plate. Therefore, any inconvenience is prevented before it happens.

As for the intermediate film, it is especially desirable to use a metal element whose atomic number is smaller than that of tungsten principally constituting the anode target film, or an alloy or a compound mainly constituted of the metal element, because each material mentioned above does not absorb undesirably the generated X rays. However, even though a material whose atomic number is relatively large is used for the intermediate film, dose of X rays absorbed in the intermediate film can be lowered to be negligible, by making the thickness thereof be thin. On the other hand, heat radiation from the target film increases a little by the existence of the intermediate film.

In accordance with such reasons, the thickness of the tungsten film constituting the anode target can be selected to be the optimum value, in consideration with the use of this kind of X-ray tubes and the range of the accelerating voltage for electron beam in operation. As for the material for the anode target film, pure tungsten is not necessarily indispensable. For example, rhenium-tungsten-alloy including a very small amount of rhenium (Re), molybdenum-tungsten-alloy including a very small amount of molybdenum (Mo), or an alloy mainly constituted of tungsten and including a very small amount of other elements can be employed.

On the other hand, as for the material for intermediate film 39, pure copper (Cu) is preferable as mentioned above, but not necessarily indispensable. A very small amount of other elements can be included. Following materials can be used: namely, a material selected from, for example, chromium (Cr), iron (Fe), nickel (Ni), silicon (Si), titanium (Ti), zirconium (Zr), niobium (Nb), rhodium (Rh), gold (Au), silver (Ag), or an alloy or a compound mainly constituted of at least one of these metal elements can be adopted. A laminate constituted of a plurality of various layers as well as single layer of one film of a material selected from the above materials can also be in use. As mentioned above, it is particularly preferable for the stability of X-ray tubes under manufacturing or in operation that a metallic material having the melting point higher than about 950°C. , whose atomic number and X-ray absorption coefficient are smaller than those of tungsten is used.

Unless interfacial exfoliation does not occur between intermediate film 39 and X-ray transmission window plate 37 or the anode target film, the thickness of intermediate film 39 is desirable to be as thin as possible. Having diversely investigated the above, it is affirmed that the thickness of the intermediate film is desirable to be 1/50 to 1/2 of the thickness of anode target film 40, preferably 1/30 to 1/3.

The thickness of X-ray transmission window plate 37 is desirable to be as thin as possible, if it can act safely and stably as a part of an evacuated envelope in operation. As for a forming method of the intermediate film or the anode target film, so-called physical vapor deposition methods (PVD) such as ion plating method or vacuum vapor deposition method as well as the above mentioned spattering method are suitable. Whole films can also be formed by a combination of these methods.

According to this invention, interfacial exfoliation of the target film being mainly constituted of tungsten formed on the inner surface of X-ray emanating window plate of beryllium can be prevented from occurring and high reliable penetrating type X-ray tubes and manufacturing methods thereof will be realized.

What is claimed is:

1. A penetrating X-ray tube, comprising:

a) an evacuated envelope;

b) a window plate of beryllium permeable to X-rays, sealed vacuum-tightly to the evacuated envelope;

c) a target film of tungsten or an alloy thereof, provided at the evacuated side of the window plate X-rays; and d) a cathode structure generating an electron beam impinging on the target film to generate the X-rays; and having a structure in which the X-rays generated out of the target film penetrate through the window plate, wherein at least one intermediate film of at least one metal element or alloy thereof different from tungsten is provided being in contact directly with both the window plate and the target film.

2. The penetrating X-ray tube of claim 1, wherein the intermediate film is made of at least one metal selected from the group consisting of copper, chromium, iron, nickel, silicon, titanium, zirconium, niobium, rhodium, gold, and silver, and alloys, and compounds thereof.

3. The penetrating X-ray tube of claim 1, wherein the intermediate film is made of a metal element whose atomic number is smaller than that of tungsten, which the target film comprises.

4. The penetrating X-ray tube of claim 1, wherein the intermediate film is 1/50 to 1/2 of the target film in thickness.

5. The penetrating X-ray tube of claim 1, wherein the intermediate film is made of at least one metal which is copper, an alloy or compound thereof.

6. The penetrating X-ray tube of claim 4, wherein the intermediate film is 1/30 to 1/3 of the anode target film in thickness.

7. The penetrating X-ray tube of claim 1, wherein the intermediate film is two-layered, and comprises a layer of iron (Fe) for a first layer at the side of the X-ray transmission window, and a layer of titanium (Ti) for a second layer at the side of the target film.

8. A method for manufacturing an X-ray tube having a window plate of beryllium permeable to X-rays, comprising the steps of:

a) forming at least one intermediate film of at least one metal element or alloy thereof different from tungsten on an inner surface of an X-ray transmission window on which a target film is to be provided; and b) forming the target film on the intermediate film.

9. The method of claim 8, wherein the intermediate film is formed by a physical vapor deposition method.

10. The method of claim 8, wherein the target film is formed by a physical vapor deposition method.

11. The method of claim 8, which comprises the steps of:

i) preparing a ring configured to hold the X-ray transmission window plate being a part of an evacuated envelope;

ii) vacuum sealing the window plate to the ring;

iii) forming the intermediate film and the target film consecutively on the inner side of the window plate; and iv) vacuum-sealing the ring to a remaining part of the evacuated envelope.

* * * * *